US009387149B2

(12) United States Patent
Jones et al.

(10) Patent No.: US 9,387,149 B2
(45) Date of Patent: Jul. 12, 2016

(54) OUTER SLEEVE AND BLANK THEREFOR

(71) Applicant: MeadWestvaco Corporation, Richmond, VA (US)

(72) Inventors: Steven P. Jones, Elon, NC (US); Marty Jones, Glen Allen, VA (US); Robert Workman, Burlington, NC (US)

(73) Assignee: WestRock MWV, LLC, Norcross, GA (US)

( * ) Notice: Subject to any disclaimer, the term of this patent is extended or adjusted under 35 U.S.C. 154(b) by 3 days.

(21) Appl. No.: 14/521,117

(22) Filed: Oct. 22, 2014

(65) Prior Publication Data

US 2015/0041339 A1 Feb. 12, 2015

Related U.S. Application Data

(63) Continuation of application No. 12/990,641, filed as application No. PCT/US2009/042527 on May 1, 2009, now abandoned.

(60) Provisional application No. 61/049,546, filed on May 1, 2008.

(51) Int. Cl.

| | |
|---|---|
| ***B65D 5/00*** | (2006.01) |
| ***A61J 1/03*** | (2006.01) |
| ***B65D 5/38*** | (2006.01) |
| ***B65D 83/04*** | (2006.01) |
| ***B65D 50/04*** | (2006.01) |
| ***B65D 75/36*** | (2006.01) |

(52) U.S. Cl.

CPC . *A61J 1/035* (2013.01); *B65D 5/38* (2013.01); *B65D 50/045* (2013.01); *B65D 75/36* (2013.01); *B65D 83/0463* (2013.01); *B65D 2215/02* (2013.01); *B65D 2215/08* (2013.01)

(58) Field of Classification Search

CPC .... B65D 5/32; B65D 5/5016; B65D 83/0463; B65D 2583/0454; B65D 2585/56; B65D 2215/04

USPC ..... 206/528; 229/125, 125.125

See application file for complete search history.

(56) References Cited

U.S. PATENT DOCUMENTS

| | | | | |
|---|---|---|---|---|
| 6,047,829 | A * | 4/2000 | Johnstone et al. | 206/531 |
| 7,389,875 | B2 * | 6/2008 | Sandberg et al. | 206/531 |
| 8,499,936 | B2 * | 8/2013 | Albrecht et al. | 206/528 |
| 2007/0251983 | A1 * | 11/2007 | Freeze | 229/125.125 |
| 2007/0272586 | A1 * | 11/2007 | Hession | 206/532 |
| 2008/0197043 | A1 * | 8/2008 | Freeze et al. | 206/538 |

* cited by examiner

*Primary Examiner* — Anthony Stashick
*Assistant Examiner* — Ernesto Grano
(74) *Attorney, Agent, or Firm* — WestRock Intellectual Property Group

(57) ABSTRACT

An outer sleeve includes first and second opposed side panels edges, hinge panels interconnecting the first and second side panels such that at least one chamber is defined between the first and second side panels, at least one of the hinge panels being hingedly connected to at least one of the first and second side panels along one of the opposed side edges of the at least one side panel, and at least one inner panel positioned at least in part inside the at least one chamber. The at least one inner panel includes a slide card locking mechanism for releasably locking at least one slide card in a locked position within the at least one chamber. The at least one side panel includes a release button positioned proximate the slide card locking mechanism of the at least one inner panel. The at least one inner panel is hingedly connected to one of the end edges of the at least one panel.

11 Claims, 6 Drawing Sheets

OUTER SLEEVE AND BLANK THEREFOR

CROSS REFERENCE

This application is a continuation of U.S. patent application Ser. No. 12/990,641, filed Nov. 1, 2010, and incorporates the same herein by reference in its entirety.

SUMMARY OF THE INVENTION

A dual dose package according to the embodiments of the invention is composed of a pair of internal slide cards and an outer sleeve. The outer sleeve and the internal slide cards may be cut from any suitable material, for example plastic, paperboard or, if desired a laminate of paperboard and another foldable material, for example a foil or a polymeric film. The selection of this substrate may be made according to the packaging need, and accordingly, a substrate material generally recognized as safe (GRAS) by the FDA is also within the scope of the invention. In certain embodiments, the substrate may be selected from a sheet of bleached sulfate board, solid unbleached sulfate board (SUS), clay-coated newsback (CCNB), or any other suitable board substrate, such a substrate preferably ranging in thickness from about 0.008 inches up to about 0.050 inches. For example, the paperboard may be clay coated on one side (C1S) or on both sides (C2S), with a coating such as a fluidized blend of mineral pigments selected from coating clay, calcium carbonate and/or titanium dioxide with starch or adhesive, or various combinations of these materials. Successive densification and polishing (via calendering) finishes each coated surface to a high degree of smoothness and renders it suitable for graphics printing of superior quality.

In a first embodiment, the outer sleeve includes a pair of side panels and an inner partition panel forming the wider surfaces of the package, these side panels and the inner partition panel being operatively connected by a plurality of hinge panels. The design of the outer sleeve creates two chambers that can each accommodate a separate inner slide card. Each of the side panels includes a slide card locking mechanism, while a pair of extension panels that provide for a false bottom to the outer sleeve include a releasing mechanism. The slide card locking mechanism can be in the form of a release button located in the side panels, while the slide card locking means can be composed of a cut away region that includes a node for engaging an extension of the internal slide card in the extension panel.

Depending on the choice of substrate material, another means of improving the impenetrability of the sleeve involves lamination of at least a part of one or both sides of the blank with a polymer film. In this manner, the exterior of the package is made more resistant to tearing. Optionally, this lamination may not extend over the entire surface of the sleeve blank. For example, only tear prone regions may require lamination. Suitable laminating materials may, for example, be selected from biaxially oriented or cross-laminated polymeric films such as high density polyethylene (HDPE), polyolefins, polyesters, e.g. Mylar™, or combinations thereof. In a related embodiment, tear resistance may be provided at stress points such as the package corners and exposed edges by applying one or more strips of the polymeric film, e.g. as a tape, over these areas. In either aspect, the polymeric film may be applied by extrusion or adhesive lamination, or by any other suitable means known in the art, typically to the side that is the interior surface of the blank. It has been found that this treatment significantly increases tear resistance and prevents tear propagation in the outer sleeve. Preferably, neither the complete laminate film nor the selectively applied film strips will detract from the package's aesthetic appearance or interfere with printability or any of the other desirable display features. Text or graphic information may be printed on the sleeve or on the surfaces of the internal slide card according to any means conventionally known in the art.

The outer sleeve of the package provides additional protection for the internal slide cards, which houses the unit dose product being used. The internal slide cards include a stop feature, typically a folded extension thereof, that engages with a catch feature, typically also a folded extension, on the outer sleeve, to prevent the user from pulling the internal slide cards completely away from the outer sleeve.

Optionally, other means for improving the structural integrity of the overall package may be incorporated. Such features include lamination of the slide card with a polymeric film, as described above, which also improves tear resistance.

DETAILED DESCRIPTION OF THE PREFERRED EMBODIMENTS OF THE INVENTION

The embodiments shown and described herein offer the ability to include multiple internal slide cards that contain the unit doses into a single packaging solution. This type of packaging increases the number of unit doses that can be included in a packaging solution and maintains the child safety and senior friendly aspects while significantly reducing the materials required to package the unit doses.

Figure 1:
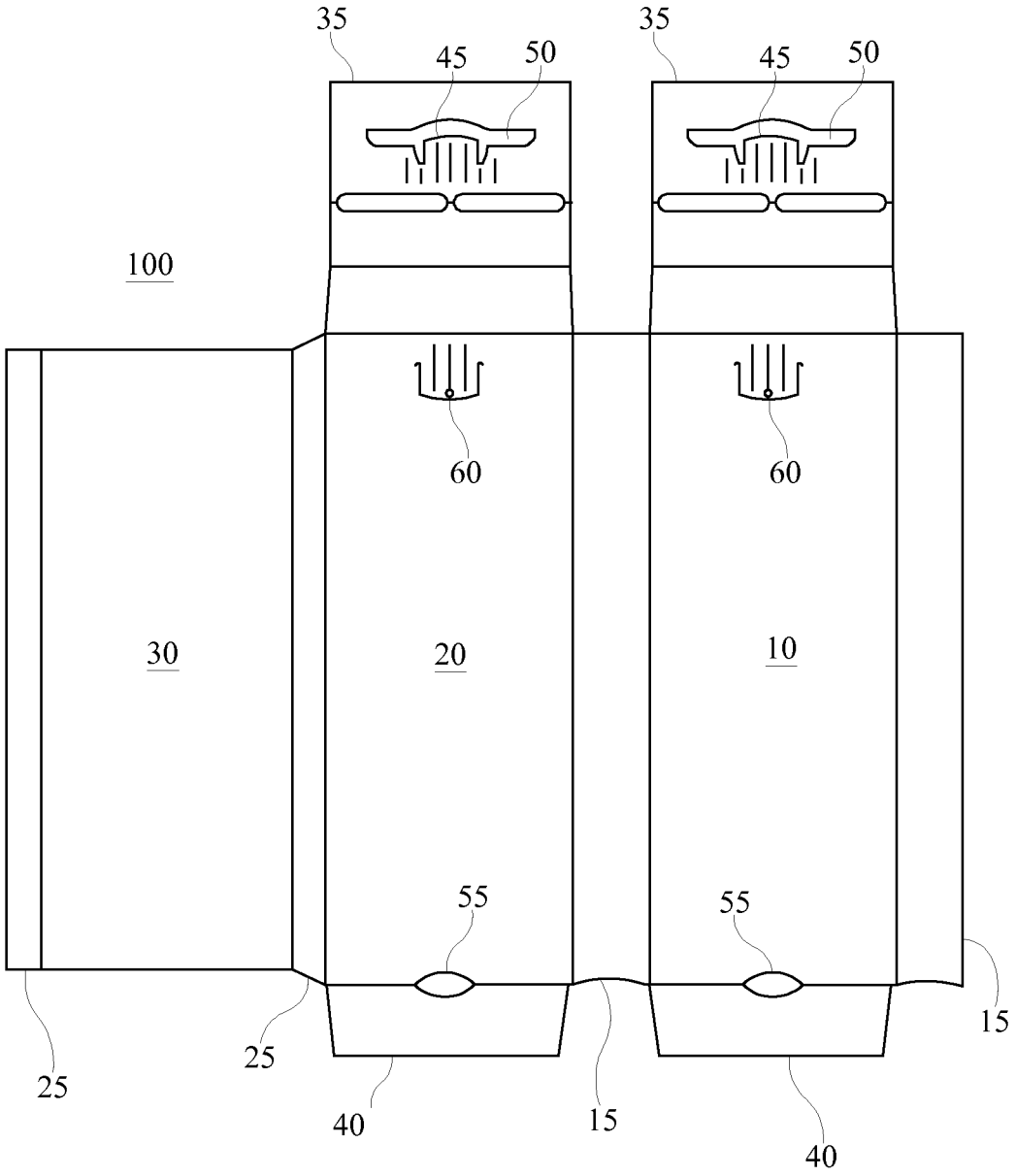
FIG. 1 is a plan drawing of an outer sleeve according to a first embodiment.

FIG. 1 is a plan drawing of an outer sleeve according to a first embodiment. An outer sleeve is formed from a blank 100 that is scored to form a pair of side panels 10, 20, an inner partition panel 30, a pair of hinge panels 15, a pair of inner partition hinge panels 25, a first pair of scored extension panels 35, and a second pair of extension panels 40.

To form the outer sleeve, one of the inner partition hinge panels 25 is folded at a right angle to side panel 20. The inner partition panel 30 is then folded at a right angle to the folded inner partition hinge panel 25 such that inner partition panel 30 is parallel to and beneath side panel 20. The other inner partition hinge panel 25 is then folded at a right angle downward from the inner partition panel 30. Next, the hinge panel 15 that is coupled with both side panels 10, 20 is folded at a right angle downward. This hinge panel 15 is approximately twice the width of the inner partition hinge panel 25. Thus, it extends downward such that the inner partition panel intersects the hinge panel 15 perpendicularly about midway its width. Side panel 10 is then folded at a right angle such that it is now parallel to and beneath inner partition panel 30 and side panel 20. The other hinge panel 15 is then folded at a right angle upwards and can be secured (e.g., using an adhesive) against the opposite edge of side panel 20 so that it completes a three dimensional rectangular box.

The first pair of scored extension panels 35 each extend from one end of side panels 10 and 20 respectively. These scored extension panels 35 further include locking mechanisms that are designed to maintain a slide card insert firmly in place. The locking mechanism is comprised of a cut-away area 50 in the extension panel 35 having a node 45. The scored extension panels 35 are folded along the score lines and inserted and secured within respective chambers defined by outer sleeve progression of side panel 10, inner partition panel 30, and side panel 20. Upon insertion, the scored extension panels form a bottom for the overall package. The locking mechanisms (cut-away area 50 and node 45) are now within a defined chamber and can operatively couple with a slide card insert when one is inserted into the chamber.

The second pair of extension panels 40 each extend from the opposite end of side panels 10 and 20 respectively. These extension panels 40 further include a cut out notch 55. These extension panels 40 are folded beneath and tucked into the openings of the chambers defined by the side panels 10, 20 and inner partition panel 30. These extension panels 40 are not sealed to any particular surface within the chamber. The cut out notch 55 is essentially circular wherein half of the circle resides on the side panel 10, 20 and the other half resides on the extension panel 40. When the extension panels 40 are folded into the chamber opening the notch 55 becomes a semi-circular cut-out that exposes the slide card insert enough that a user can grasp and pull the slide card insert out from the sleeve. The main purpose of these extension panels 40 is to serve as a retaining element for a slide card insert. When a slide card insert is pulled outward, it will extend until a reciprocal element on the slide card insert engages the extension panel 40.

Each side panel 10, 20 further includes a release mechanism in the form of a release button 60. To release a slide card insert so that it can be withdrawn from its chamber within the outer sleeve, the user simultaneously grasps the slide card insert with one hand via notch 55 and depresses the release button 60 with his other hand. The release button 60 pushes downward on the slide card insert to unhook it from the locking mechanism 45, 50 situated on extension panel 35.

While not shown, the open end of the defined chambers can be temporarily sealed such that the seal must be removed before a slide card can be accessed. This would prevent access to the slide card contents prior to purchase for certain over-the-counter (OTC) products that utilize this packaging. The end can be sealed with, for instance, a tuck closure, a perforated tear-away panel, a security taped panel, etc.

Figure 2:
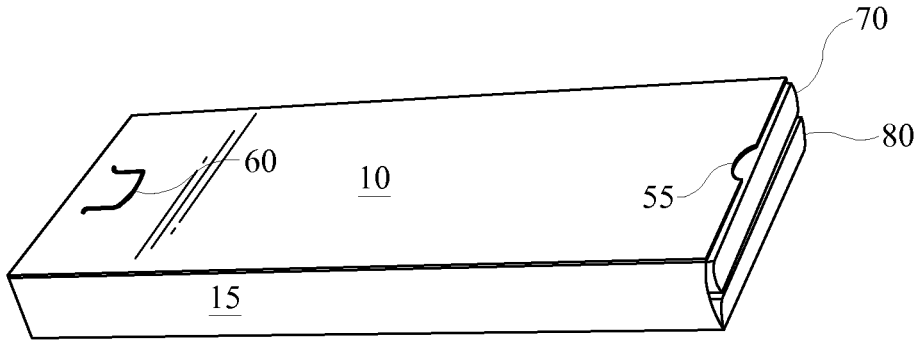
FIG. 2 is a first isometric view of a package according to the first embodiment.

FIG. 2 is a first isometric view of a package according to the first embodiment. This figure shows the outer sleeve fully formed and containing a pair of internal slide cards 70, 80. The release button 60 and notch 55 are visible on side panel 10.

Figure 3:
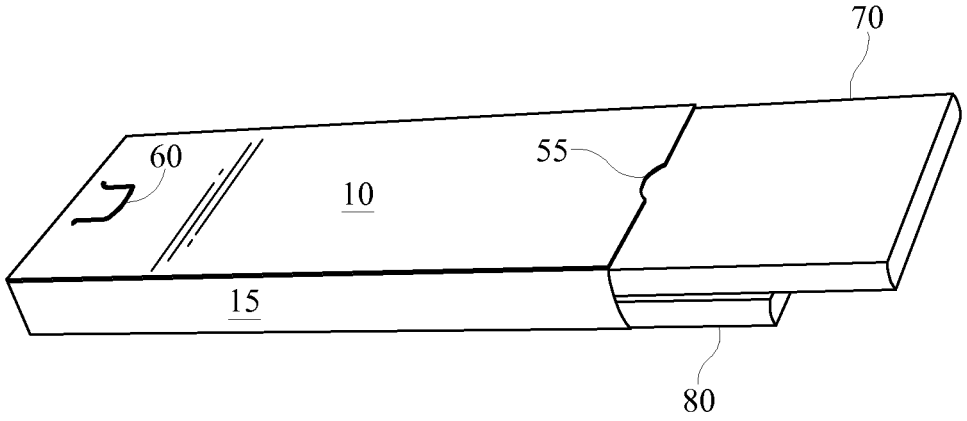
FIG. 3 is a second isometric view of a package according to the first embodiment.

FIG. 3 is a second isometric view of a package according to the first embodiment. This view is similar to FIG. 2 but further shows the internal slide cards 70, 80 partially removed from the outer sleeve.

Figure 4:
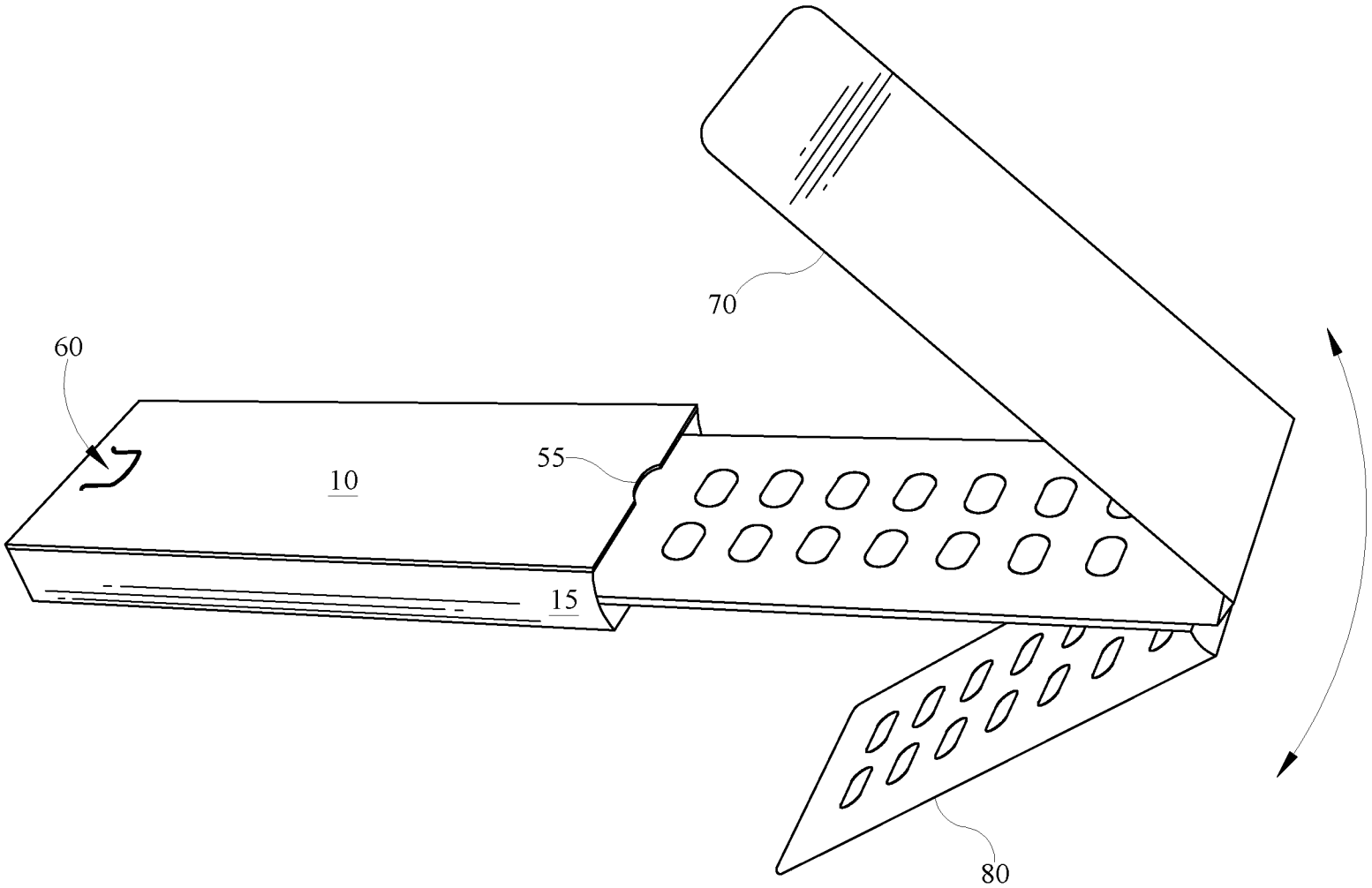
FIG. 4 is a third isometric view of a package according to the first embodiment.

FIG. 4 is a third isometric view of a package according to the first embodiment. This view is similar to FIGS. 2 and 3. This time the internal slide cards 70, 80 are shown fully removed from the outer sleeve such that the individual doses stored on the internal slide cards are exposed and accessible.

Figure 5:
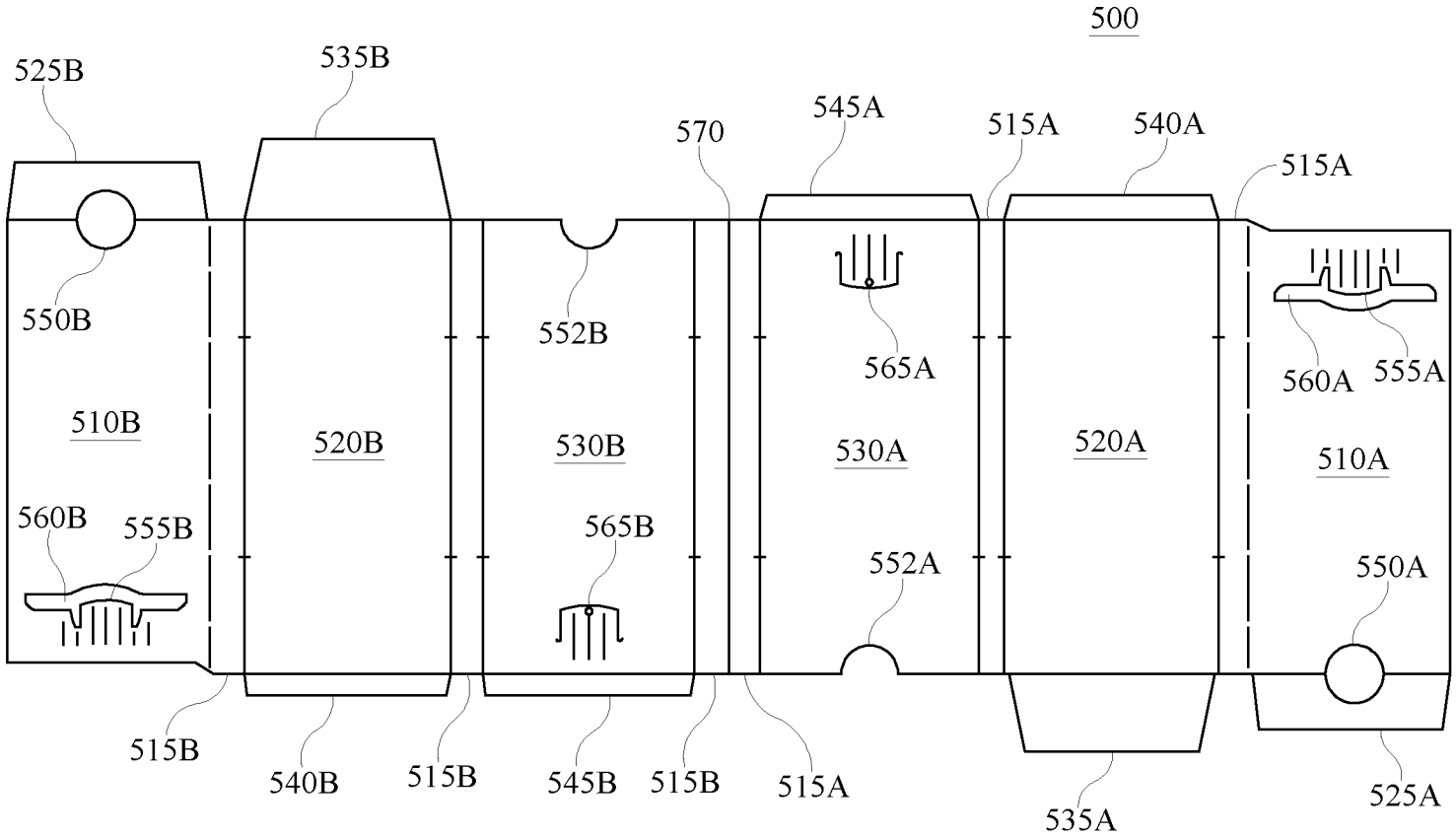
FIG. 5 is a plan drawing of an outer sleeve according to a second embodiment.

FIG. 5 is a plan drawing of an outer sleeve according to a second embodiment. In this embodiment, two separate outer sleeve packages are joined together along a common hinge line 570. The outer sleeves are formed from a blank 500 that is scored to form six panels. Each outer sleeve includes three of the panels separated by a common hinge such that one set of three panels is an inverted mirror image of the other set of three panels. To form one of the outer sleeves, a first panel 510A is folded beneath and secured, for example using an adhesive, beneath a second panel 530A, such that panel 510A is positioned within the interior of the formed outer sleeve. The side panels 510A, 520A, 530A are each separated by a set of hinge panels 515A. The hinge panels 515A provide a depth element to the outer sleeve and create an inner chamber adapted to receive and house an inner slide card containing unit doses.

The panel 510A includes a panel extension 525A, which acts as a stopping device that prevents an internal slide card from being withdrawn completely from the outer sleeve. A third panel 520A includes an additional extension 540A, which may be folded toward the center of panel 520A to form a bottom that strengthens the package and thus renders it more tamper resistant. Extension panel 545A will overlap and be secured to extension panel 540A to complete the bottom of the outer sleeve packaging. Panel 510A additionally includes a cut away area 560A having a node 555A. The cut away area 560A, node 555A, and a release button 565A, and an extension panel 525A together form the locking assembly for the package. The locking mechanism operates similarly to that described in U.S. Pat. No. 6,047,829, herein incorporated by reference. The blank 500 also includes a cutaway area 550A, which, when folded together, form a notch that is paired with notch 552A.

The opposite side panels 510B, 520B, 530B as wells as hinge panels 515B are folded in the same fashion as described above to form the second outer sleeve. Once folded, there will be two separate outer sleeve units that are inseparably joined along a common hinge line 570. Each outer sleeve is capable of housing an internal slide card.

The locking mechanisms 555A, 560A, 555B, 560B operate in conjunction with release buttons 565A, 565B as described above with respect to FIGS. 1-4. Similarly, extension panels 535A, 535B serve to retain the internal slide cards from being completely extracted from within the chambers defined by the outer sleeves.

Figure 6:
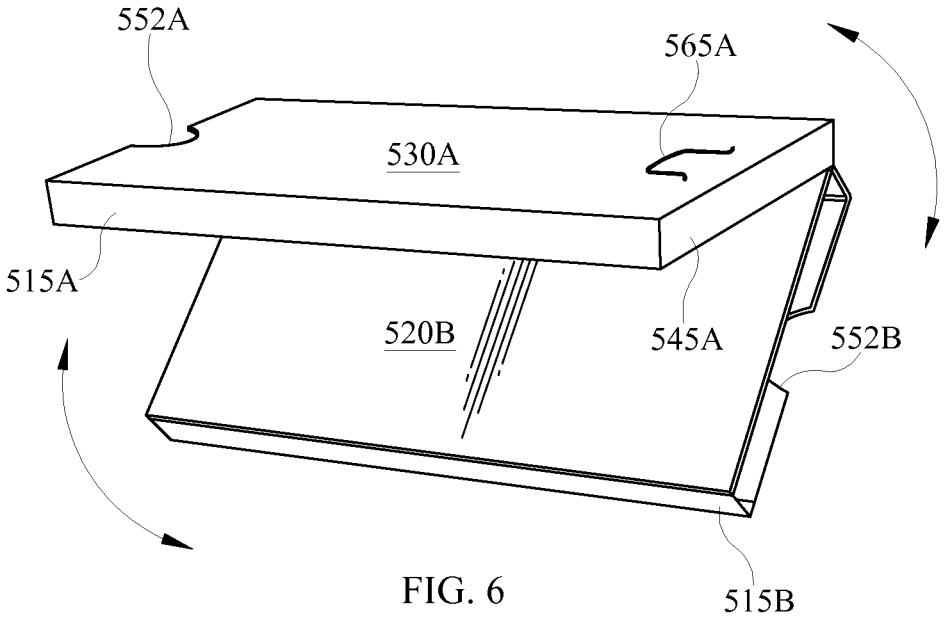
FIG. 6 is a first isometric view of a package according to the second embodiment.

FIG. 6 is a first isometric view of a package according to the second embodiment. This view shows both outer sleeves joined at a common hinge line partially separated from one another. On the upper outer sleeve, side panel 530A is visible and includes release button 565A and notch 552A. One of the hinge panels 515A as well as extension panel 545A that forms a bottom are also visible. On the lower outer sleeve, side panel 520B, hinge panel 515B, and notch 552B are visible.

Figure 7:
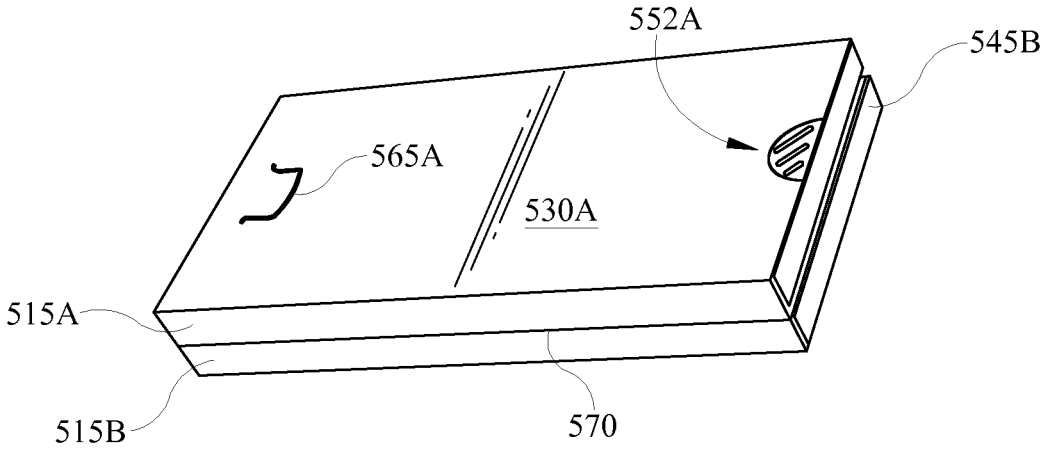
FIG. 7 is a second isometric view of a package according to the second embodiment.

FIG. 7 is a second isometric view of a package according to the second embodiment. This view shows both outer sleeves joined at a common hinge line 570 with no separation from one another. On the upper outer sleeve, side panel 530A is visible and includes release button 565A and notch 552A. One of the hinge panels 515A is also visible. On the lower outer sleeve, hinge panel 515B, and as well as extension panel 545B that forms a bottom are visible.

Figure 8:
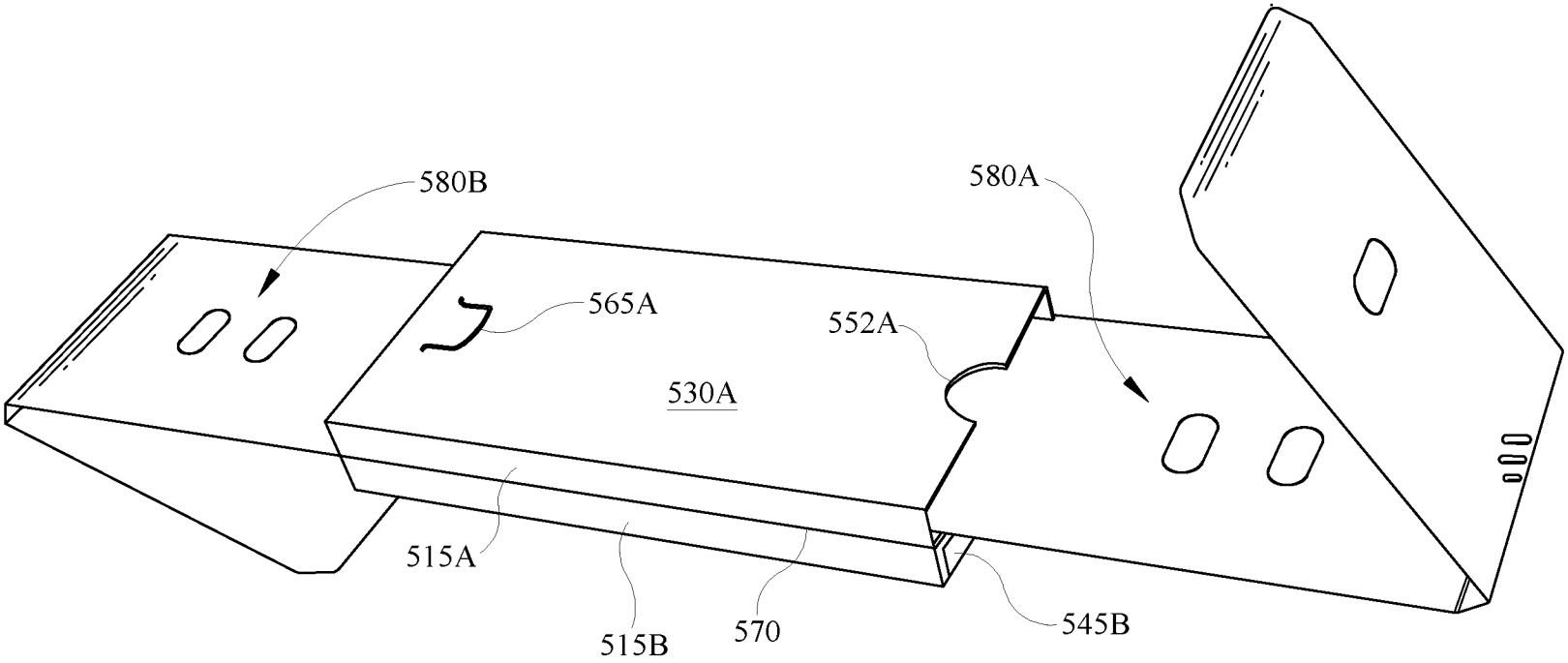
FIG. 8 is a third isometric view of a package according to the second embodiment.

FIG. 8 is a third isometric view of a package according to the second embodiment. FIG. 8 is the same as FIG. 7 but it also illustrates the internal slide cards 580A, 580B withdrawn from the outer sleeve chambers to the extent that the unit doses contained on the internal slide cards 580A, 580B are exposed and accessible.

The description above has made reference to slide cards that can be inserted and withdrawn from the packaging. The slide cards generally hold a plurality of unit doses contained within what is commonly referred to as blister packs. Thus, the slide cards may take the form of solely a blister pack, a blister pack heat sealed to a substrate, a blister pack glued (e.g., hot melted) to a substrate, or a blister pack encased by a slotted substrate.

The package of the present invention offers advantages in that it can accommodate two blister pack containing internal slide cards, is lightweight, tamper resistant, senior friendly, durable, easy to assemble, offers protection of each unit dose until it is consumed, and is economical. Moreover, the invention provides a child resistant yet user-friendly unit dose packaging container, which may be used to contain and dispense a variety of contents. The improved tamper resistant features of the package may be attributed, at least in part, to the presence of the false bottom structural support, the offset notch placement and the use of partially or fully laminated structural materials in construction of the package sleeve and slide card. Suitably, the package may, for example, be used to store pharmaceuticals preparations requiring repeat periodic dosage regimens. As used herein, the term "pharmaceutical preparation" is intended to include prescribed or over the counter drugs or supplements, vitamins or other medicaments, or any other materials suitable for containment in a package of foil/paperboard or plastic construction.

It is believed that the present invention includes many other embodiments that may not be herein described in detail, but would nonetheless be appreciated by those skilled in the art from the disclosures made. Accordingly, this disclosure should not be read as being limited only to the foregoing examples or only to the designated preferred embodiments.

The invention claimed is:

1. An outer sleeve for receiving at least one slide card, the outer sleeve comprising:

a first side panel and a second side panel opposed to the first side panel, each of the first and second side panels defined by a first side edge and a second, opposed side edge and a pair of opposed end edges each extending between the side edges;

a plurality of hinge panels interconnecting the first and second side panels such that at least one chamber is defined between the first and second side panels to slidably and lockably receive at least one slide card, at least a first one of the hinge panels hingedly connects the first and second side panels along their respective first side edges, and a second one of the hinge panels connects the second, opposed side edges of the first and second side panels; and at least one inner panel positioned at least in part inside the at least one chamber, the at least one inner panel including a slide card locking mechanism for releasably locking at least one slide card in a locked position within the at least one chamber, wherein the at least one of the first and second side panels includes a release button positioned proximate the slide card locking mechanism of the at least one inner panel, and wherein the at least one inner panel comprises one or more panels, one of which is directly hingedly connected to one of the end edges of the at least one of the first and second side panels.

2. The outer sleeve of claim 1, wherein the at least one inner panel is provided by a scored extension panel that is directly connected to the one of the end edges of the at least one of the first and second side panels, the scored extension including at least one section that forms at least part of an end closure structure of the outer sleeve.

3. A blank for forming an outer sleeve for housing at least one slide card, the blank comprising:

first and second opposed side panels each defined by a first side edge and an opposed second side edge and a pair of opposed end edges each extending between the side edges;

a plurality of hinge panels, at least one of the hinge panels interconnecting the first and second side panels such that at least one chamber is defined between the first and second side panels, when the blank forms an outer sleeve, to slidably and lockably receive at least one slide card, at least a first one of the hinge panels hingedly connects the first and second side panels along their first side edges and at least a second one of the hinge panels connects the opposed side edges of the first and second side panels when the blank forms an outer sleeve; and at least one inner panel positioned at least in part inside the at least one chamber when the blank forms an outer sleeve, the at least one inner panel including a slide card locking mechanism for releasably locking at least one slide card in a locked position within the at least one chamber, wherein the at least one of the first and second side panels includes a release button that is positioned proximate the slide card locking mechanism when the blank forms an outer sleeve, and wherein the at least one inner panel comprises one or more panels, one of which is directly hingedly connected to one of the end edges of the at least one of the first and second side panels.

4. The blank of claim 3, wherein the at least one inner panel is provided by a scored extension panel that is directly connected to the one of the end edges of the at least one of the first and second side panels, the scored extension including at least one section for forming at least part of an end closure structure of an outer sleeve.

5. An outer sleeve for receiving at least two slide cards, the outer sleeve comprising:

first and second opposed side panels;

a partition structure disposed between the first and second side panels in a spaced parallel relationship with the first and second side panels;

a plurality of hinge panels interconnecting the first and second side panels and the partition structure such that a first chamber is defined between the first side panel and the partition structure to slidably and lockably receive at least one slide card and such that a second chamber is defined between the second side panel and the partition structure to slidably and lockably receive at least one slide card; and a pair of inner panels positioned at least in part inside the first and second chambers respectively, each of the inner panels extending from an end of a respective one of the opposed side panels and including a slide card locking mechanism for releasably locking at least one slide card in a locked position within a respective one of the first and second chambers, wherein each of the first and second chambers has a closed end and an opposed open end, and wherein the open end of the first chamber is located at one end of the outer sleeve, and the open end of the second chamber is located at the other end of the outer sleeve.

6. The outer sleeve of claim 5, wherein each of the first and second side panels is defined by a pair of opposed side edges and a pair of opposed end edges, and wherein one of the side edges of the first side panel is hingedly connected to one of the side edges of the second side panel through at least one of the hinge panels.

7. The outer sleeve of claim 6, wherein the inner panel in the first chamber is hingedly connected to one of the end edges of the first side panel through at least two extension panels, and wherein the inner panel in the second chamber is hingedly connected to one of the end edges of the second side panel through at least two extension panels.

8. The outer sleeve of claim 5, wherein each of the first and second side panels includes a release button positioned proximate the slide card locking mechanism of a respective one of the inner panels.

9. A blank for forming an outer sleeve for housing a plurality of slide cards, the blank comprising:

a plurality of hinge panels;

a first side panel and a second side panel hingedly interconnected by at least one of the hinge panels;

at least one partition panel to be disposed between the first and second side panels when the blank is erected into a form of an outer sleeve such that first and second separate chambers are defined by the hinge panels, by the first and second side panels and by the at least one partition panel; and a pair of inner panels to be positioned at least in part inside the first and second chambers respectively when the blank takes the form of an outer sleeve, each of the inner panels including a slide card locking mechanism for releasably locking at least one slide card in a locked position within a respective one of the first and second chambers, wherein the slide card locking mechanism of one of the inner panels is located at a position along one of opposed end edges of the blank, and the slide card locking mechanism of the other of the inner panels is located at a position along the same end edge of the blank.

10. The blank of claim 9, wherein each of the first and second side panels includes a release button positioned proximate the slide card locking mechanism of a respective one of the inner panels when the blank takes the form of an outer sleeve.

11. The blank of claim 9, wherein each of the first and second side panels is defined by a pair of opposed side edges and a pair of opposed end edges, and wherein one of the side edges of the first side panel is hingedly connected to one of the side edges of the second side panel through the at least one of the hinge panels.

* * * * *